US008493040B2

(12) United States Patent
Gunther et al.

(10) Patent No.: US 8,493,040 B2
(45) Date of Patent: Jul. 23, 2013

(54) VOLTAGE REGULATOR WITH CHARGE PUMP

(75) Inventors: Andre Gunther, San Jose, CA (US); Kevin Mahooti, Sunnyvale, CA (US)

(73) Assignee: NXP B.V., Eindhoven (NL)

( * ) Notice: Subject to any disclaimer, the term of this patent is extended or adjusted under 35 U.S.C. 154(b) by 174 days.

(21) Appl. No.: 13/198,210

(22) Filed: Aug. 4, 2011

(65) Prior Publication Data

US 2013/0033242 A1 Feb. 7, 2013

(51) Int. Cl.
*G05F 1/577* (2006.01)

(52) U.S. Cl.
USPC ..... 323/267

(58) Field of Classification Search
USPC ..... 323/265, 267, 268, 273, 282; 363/59; 327/536; 331/177 R
See application file for complete search history.

(56) References Cited

U.S. PATENT DOCUMENTS 5,426,334 A * 6/1995 Skovmand ..... 327/427
7,019,506 B2 * 3/2006 Kernahan ..... 323/284
7,038,552 B2 * 5/2006 Brett et al. ..... 331/183
7,492,228 B2 * 2/2009 Strange ..... 331/16
7,920,000 B2 * 4/2011 Kawashima ..... 327/156
7,940,139 B2 * 5/2011 Kodama ..... 331/177 R
8,054,651 B2 * 11/2011 Pollard ..... 363/17
8,081,040 B1 * 12/2011 Avitan ..... 331/186
2001/0033501 A1 * 10/2001 Nebrigic ..... 363/49
2002/0017898 A1 * 2/2002 Bayer et al. ..... 323/313
2008/0094128 A1 * 4/2008 Ito et al. ..... 327/536
2009/0160411 A1 * 6/2009 Tran et al. ..... 323/268
2010/0176888 A1 * 7/2010 Kodama ..... 331/15

* cited by examiner

*Primary Examiner* — Adolf Berhane

(57) ABSTRACT

In one embodiment, a regulator circuit is provided. The regulator circuit includes a control circuit configured and arranged to adjust an oscillation frequency of a variable frequency oscillator in response to a feedback signal indicating the regulated output voltage. A charge pump is coupled to an output of the variable frequency oscillator and is configured to charge one or more energy storage elements in response to the output of the variable frequency oscillator. The regulator circuit includes a plurality of output stages, each having an input driven by the output of the charge pump and being configured to drive the regulated output voltage. Each output stage is selectably enabled or disabled in response to respective enable signal provided to the output regulator by an enable control circuit.

20 Claims, 5 Drawing Sheets

VOLTAGE REGULATOR WITH CHARGE PUMP

Voltage regulators are often used in electronic devices to generate a stable output voltage from a varying power supply. The current load of a device may change dynamically during operation. This change may cause fluctuations in the output voltage, which may adversely affect operation of the device. A voltage regulator adjusts supplied power according to changes in the load in order to maintain a stable voltage.

Some voltage regulators are configured to exhibit a low dropout voltage. In these contexts, the term dropout voltage is generally used to refer to the minimum difference between the input unregulated voltage to the LDO regulator (such as a battery or power bus) and the regulated voltage output from the LDO regulator at max output current conditions. Linear regulators maintain the regulated output voltage while an unregulated voltage supply remains above the dropout voltage. LDO regulators exhibit a relatively small dropout voltage that helps extend the life of the battery because the LDO regulator can continue to provide a regulated voltage until the battery is discharged to a value that is within a relatively close range (e.g., 100-500 millivolts) of the regulated voltage.

In one embodiment, a regulator circuit having a low drop out voltage is provided. The regulator circuit includes a control circuit configured and arranged to adjust an oscillation frequency of a variable frequency oscillator in response to a feedback signal indicating the regulated output voltage. A charge pump is coupled to an output of the variable frequency oscillator and is configured to charge one or more energy storage elements in response to the output of the variable frequency oscillator. The regulator circuit includes a plurality of output stages, each output stage having an input driven by the output of the charge pump and being configured to drive the regulated output voltage. Each output stage is selectably enabled or disabled in response to a respective enable signal provided to the output regulator by an enable control circuit.

In another embodiment, a circuit for producing a regulated voltage is provided. The circuit includes a charge pump having a control input coupled to an output of a fixed frequency oscillator. The charge pump is configured and arranged to charge and discharge a plurality of energy storage elements, in response to the output of the variable frequency oscillator, to produce a voltage signal at a rate controlled by the fixed frequency oscillator. The regulator includes a plurality of selectably enabled output stages driven by the voltage signal and configured to provide a respective regulated output voltage, in response to a respective enable signal provided to the output stages.

In yet another embodiment, a regulator circuit is provided. The regulator circuit includes a charge pump having a control input coupled to an output of an oscillator. The charge pump is configured and arranged to charge one or more energy storage elements, in response to the output of the oscillator, to produce voltage signal at a rate controlled by the oscillator. The regulator circuit also includes a plurality of output stages. Each output stage has an input driven by the voltage signal and configured to provide one or more respective regulated output voltages in response to respective enable signals provided to the output stages. A control circuit is configured and arranged to adjust the voltage signal, via the charge pump, in response to one or more of the one or more respective regulated output voltages.

The above discussion is not intended to describe each embodiment or every implementation. The figures and following description also exemplify various embodiments.

Various example embodiments may be more completely understood in consideration of the following detailed description in connection with the accompanying drawings, in which.

Figure 4:
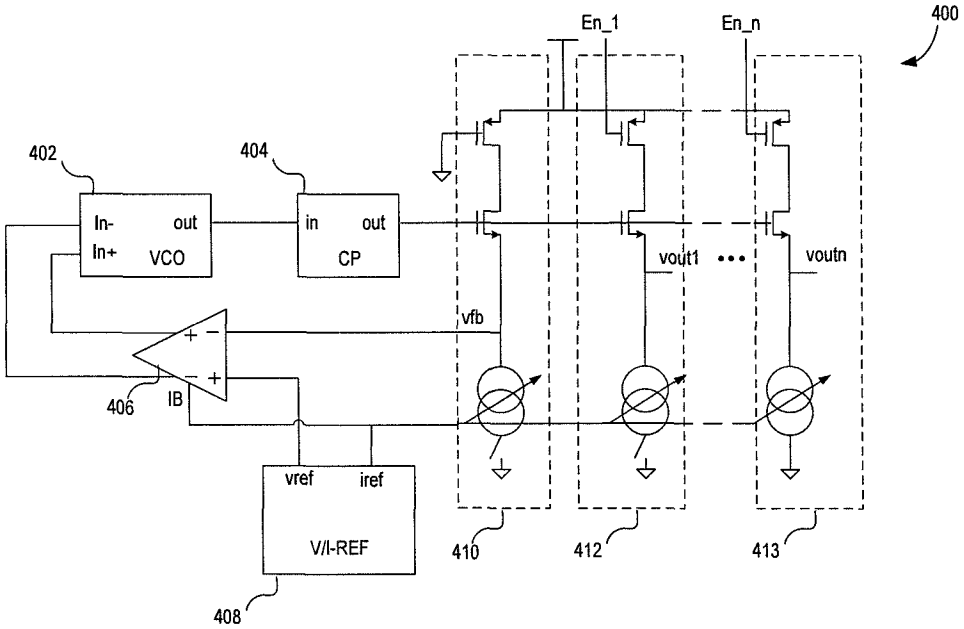
Figure 5:
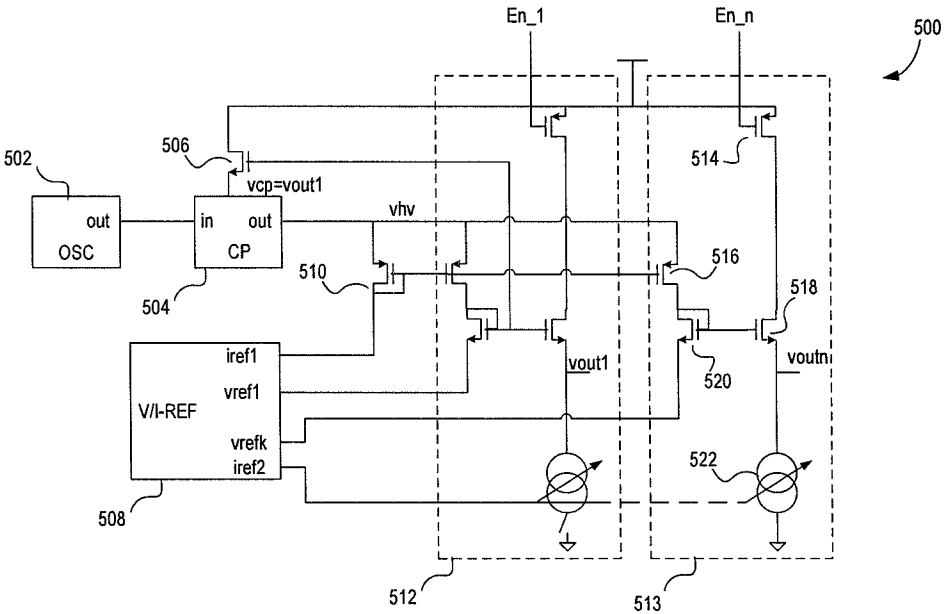

FIG. 4 shows a circuit diagram of an example LDO regulator circuit implemented with a voltage controlled oscillator and differential voltage feedback amplifier, in accordance with one or more example embodiments; and FIG. 5 shows a circuit diagram of an example LDO regulator circuit implemented with fixed frequency oscillator and multiple output voltage generation, in accordance with one or more example embodiments.

While the disclosure is amenable to various modifications and alternative forms, some various implementations thereof have been shown by way of example in the drawings and are described in detail below. It should be understood, however, that the intention is not to limit the disclosure to the particular embodiments shown and/or described. On the contrary, the intention is to cover all modifications, equivalents, and alternatives falling within the spirit and scope of the disclosure.

The disclosed embodiments are believed to be applicable to a variety of different types of processes, devices, and arrangements for use with various regulator circuits. While the embodiments are not necessarily so limited, various aspects of the disclosure may be appreciated through a discussion of examples using this context.

One or more embodiments provide a power efficient voltage regulator with low drop-out voltage. The regulator includes a plurality of output stages, which are driven by an output of a charge pump. Use of the charge pump allows to drive the inputs of the output stages above the source voltage Vdd. In this manner, a low dropout voltage is achieved. The charge pump generates the voltage used to drive the output stages in response to an output of a variable frequency oscillator. The frequency of the variable frequency oscillator adjusted in response to a feedback control signal. The feedback control signal is generated by comparing an output voltage to a reference voltage. As the feedback voltage increases and approach the reference voltage, the feedback control signal reduces the frequency of the variable frequency oscillator and the current drawn by the charge pump is reduced proportionally. In this manner, when less load is placed on the regulator, less power is required to operate the regulator.

A feedback circuit may be configured to control the variable frequency oscillator in a number of different way. In one or more embodiments the variable frequency oscillator is implemented with a voltage controlled oscillator and is controlled by a voltage difference amplifier configured to compare an output voltage with a reference voltage. In one or more other embodiments, the variable frequency oscillator is implemented with a current controlled oscillator and is controlled by a transconductance amplifier configured to compare the output voltage with the reference voltage. In yet one or more other embodiments, the variable frequency oscillator is implemented with a voltage controlled oscillator that is controlled by a differential signal generated from the difference between the output voltage and the reference voltage.

In one or more embodiments, a feedback control voltage is generated using a replica output stage rather than from an actual output of the regulator. As a result, an increase in load current on one of the output stages will not cause the regulator to increase voltage signal output from the charge pump. This allows several output stages to be driven from the same voltage without transferring noise between output stages and may be useful in a number of applications that are sensitive to power supply noise.

In one or more embodiments, a voltage regulator includes a plurality of output stages that may be selectably enabled or disabled. The output stages may provide power for different sections of a power grid or for separate circuits. Different ones of the output stages may be biased differently to produce different output voltages. Through biasing and/or selective enabling, different output stages may be programmably adjusted to produce different regulated output voltages.

Figure 1:
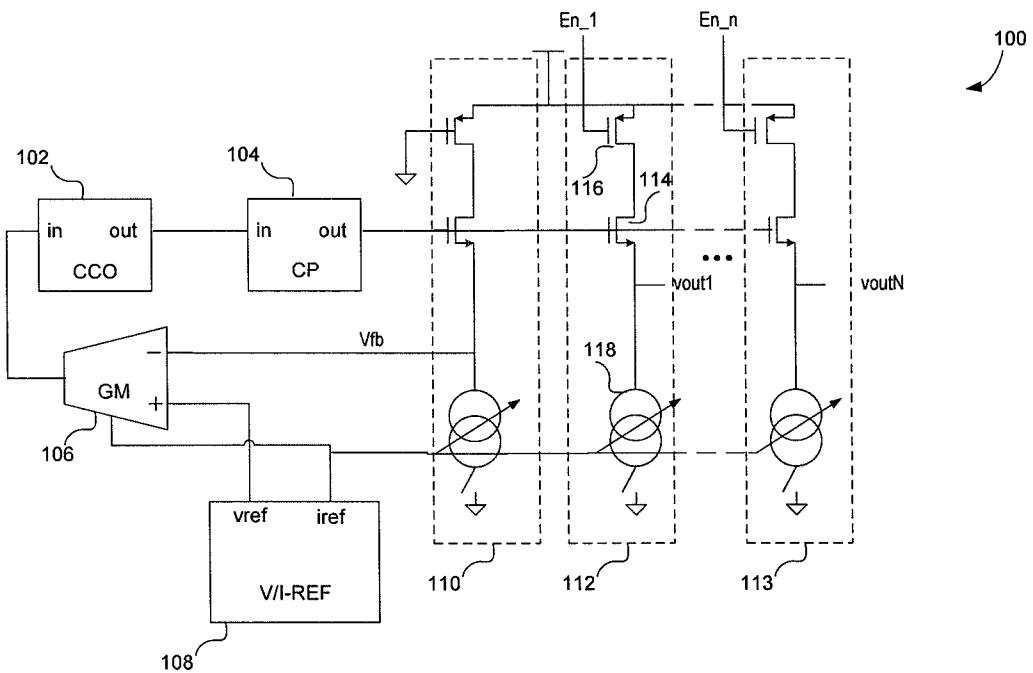
FIG. 1 shows a circuit diagram of an example LDO regulator circuit implemented with a current controlled oscillator and transconductance feedback amplifier, in accordance with one or more example embodiments.

FIG. 1 shows a regulator circuit 100 implemented in accordance with one or more example embodiments. The regulator circuit includes a plurality of output stages 112 and 113 that are driven by a voltage signal produced by a charge pump 104. Each output stage has an input driven by a voltage signal output from the charge pump 104. Each output stage (e.g. 112) is configured to drive a regulated output voltage Vout using a transistor 114 arranged in a source follower configuration with current source 118. The transistor 114 is biased by current source 118 according to a reference current iref.

The minimum supply voltage of the transistor 114 is equivalent to $V_{DD}>Vo+V_{GS}+V_{DS}+R_{on}I_{out}$ where Vo is the required output voltage, $V_{GS}$ is the Gate-to-Source voltage of the output transistor (equal to $V_{GS}=V_{tn}+V_{eff}$), $V_{DS}$ is the saturation voltage of transistor 114, $I_{out}$ is the load current and $R_{on}$ is the "on resistance" of switch 116. Use of the charge pump to drive the gate of the NMOS transistor allows each of the output stages 112 and 113 to operate using lower supply voltage. In this manner, a low dropout voltage is achieved.

Various NMOS transistors as discussed herein may exhibit a low output impedance and provide built-in feedback during operation. If the output load current demand rapidly increases, the accompanied drop in output voltage will automatically increase the Gate-to-Source bias of the output transistor. Due to this increase in voltage, the transistor can automatically source more current to the load. The feedback loop does thus not limit the response time and the output voltage does not collapse. P-MOS type regulators, which may also be implemented with various embodiments, rely on the feedback loop to increase the Gate-to-Source voltage of the output transistor and require additional output capacitance to handle to load current step to compensate for the loop response time. Faster control loops employ smaller decoupling capacitors at the expense of greater current consumption. For ease of illustration, the examples and embodiments are illustrated and described herein using NMOS transistors to drive a regulated output voltage of each output stage 112. However, various embodiments including those described herein are not so limited and may alternatively be configured to use PMOS transistors.

Each output stage is selectably enabled or disabled by a respective PMOS transistor 116 in response to a respective enable signal (En_1, En_n) provided to the output regulator by an enable control circuit (not shown) and may be used to individually enable or disable power to the connected loads. Output stages may provide power for different sections of a power grid or for separate circuits. The enabling/disabling mechanism may be used to conserve power by eliminating leakage currents in unused area of a chip or provide more efficient load balancing across a power network. For example, in some applications, the enable control may be configured to enable and disable one of the plurality of output stages 112 and 113 in response to large increases or decreases in load current demands.

The regulator circuit 100 includes a control circuit configured and arranged to adjust an oscillation frequency of a variable frequency oscillator 102 in response to a feedback signal indicating the regulated output voltage. A charge pump 104 is coupled to an output of the current controlled oscillator 102 and is configured to charge one or more energy storage elements of the charge pump in response to the output of the variable frequency oscillator 102.

The control circuit includes a replica output stage 110 that is configured similar to the plurality of output stages 112 and 113, a difference amplifier 106, and a reference voltage generator 108. The replica output stage 110 derives a feedback voltage Vfb that is proportional to the output voltage Vout. In this example, the replica output stage 110 is implemented to be the same as one of the output stages 112 and 113, except that the gate of the enable PMOS transistor 116 is connected to ground. This causes the replica output stage 110 to always be enabled.

The difference amplifier 106 compares the output of the replica output stage Vfb to a reference voltage Vref generated by the reference voltage and current generator 108 to produce an error signal that is used to control the frequency of the variable frequency oscillator. In this embodiment, the variable frequency oscillator 102 is implemented using a current controlled oscillator and the difference amplifier 106 is implemented with a transconductance amplifier 106. During startup, the output voltage Vout and the feedback voltage Vfb are low and the transconductance amplifier 106 supplies (about) maximum input current to the current-controlled oscillator 102. As the output voltage Vout and the feedback voltage Vfb increase and approach a reference voltage Vref, the output current of the transconductance amplifier 106 diminishes. As a result, the frequency of the current controlled oscillator 102 reduces and the current drawn by the oscillator 102 and charge pump 104 reduce proportionally.

Because feedback of the control circuit is provided using a replica feedback stage 110, an increase in load current on one of the output stages 112 and 113 will not cause the regulator to increase voltage signal output from the charge pump. The net effect is reduced load regulation as well as reduced peak-to-peak noise of the output voltage. This allows several output stages to be driven from the same voltage without transferring noise between output stages. This is useful to isolate noisy and power hungry loads from those that may be particularly sensitive to power supply noise.

Figure 2:
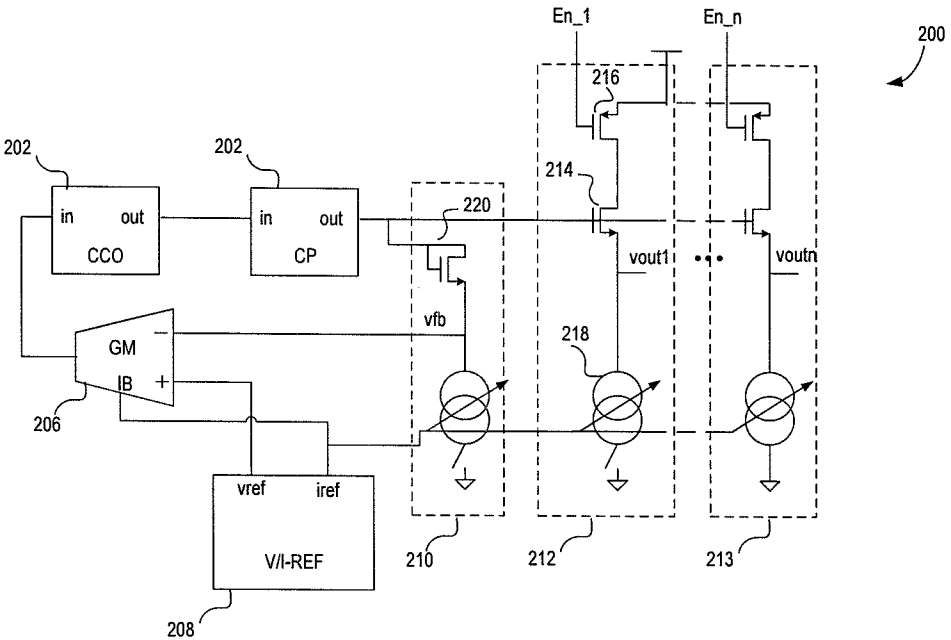
FIG. 2 shows a circuit diagram of another example LDO regulator circuit implemented with a current controlled oscillator and transconductance feedback amplifier, in accordance with one or more example embodiments.

In one or more embodiments, the charge pump includes a small leakage circuit that ensures stability and a minimum frequency of operation regardless of the frequency of the variable frequency oscillator. In some other embodiments, the leakage circuit may be implemented external to the charge pump. FIG. 2 shows a regulator with a leakage circuit implemented at the output of the charge pump, in accordance with an example embodiment. The regulator 200 includes a plurality of output stages 212 and 213, a replica stage 210, a charge pump 204, a difference amplifier 206, a current controlled oscillator 202, and a reference voltage generator 208, which may operate in similar manner to the plurality of output stages 112 and 113, replica stage 110, charge pump 104, difference amplifier 106, variable frequency oscillator 102, and reference voltage generator 108 shown in FIG. 1

In this embodiment, the regulator 200 implements replica feedback stage 210 to provide a leakage path at the output of the charge pump by coupling the gate and drain of NMOS transistor 220 to implement a diode. As a result, no leakage internal to the charge pump is needed, resulting in less current consumption. Assuming equal leakage currents between the regulators of FIG. 1 and FIG. 2, the power savings is approximately equal to the power consumption of the replica stage 110 shown in FIG. 1.

Figure 3:
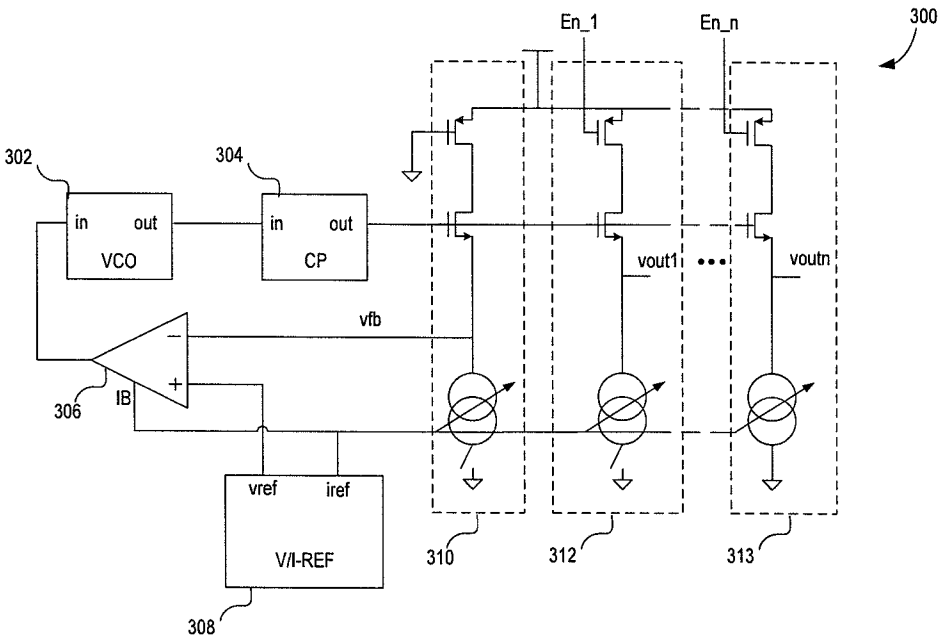
FIG. 3 shows a circuit diagram of an example LDO regulator circuit implemented with a voltage controlled oscillator and voltage feedback amplifier, in accordance with one or more example embodiments.

In the regulator circuits illustrated in FIGS. 1 and 2, the difference amplifier 106 is implemented using a transconductance amplifier that outputs an error current to control the frequency of a current controlled oscillator used to implement a variable frequency oscillator. In some other embodiments, the voltage amplifier may similarly be used to output an error voltage to control the frequency of a voltage controlled oscillator. FIG. 3 shows a regulator configured to control the variable frequency oscillator using a voltage control signal, in accordance with another example embodiment. The regulator 300 includes a plurality of output stages 312 and 313, a replica stage 310, a charge pump 304, a difference amplifier 306, a voltage controlled oscillator 302, and a reference voltage generator 308, which may operate in similar manner to the plurality of output stages 112 and 113, replica stage 110, charge pump 104, difference amplifier 106, variable frequency oscillator 102, and reference voltage generator 108 shown in FIG. 1. The regulator 300 uses a voltage controlled oscillator 302 and a voltage amplifier feedback 306 to generate the output voltage dependent frequency necessary to control the output transistors.

In some applications, use of voltage signaling to implement feedback control may increase susceptibility to noise and require more attention during the design and layout phase. For such applications, the regulator may be implemented to control the variable frequency oscillator using differential signaling, which may improve noise immunity. FIG. 4 shows a regulator configured to control the variable frequency oscillator using a differential voltage control signal. The regulator 400 includes a plurality of output stages 412 and 413, a replica stage 410, a charge pump 404, a difference amplifier 406, a voltage controlled oscillator 402, and a reference voltage generator 408, which may operate in similar manner to the plurality of output stages 112 and 113, replica stage 110, charge pump 104, difference amplifier 106, variable frequency oscillator 102, and reference voltage generator 108 shown in FIG. 1. In this implementation, a differential input/output amplifier 406 is used to drive the variable frequency oscillator 402 using a differential signal.

In some embodiments, different output stages of the regulators shown in FIGS. 1-4 (e.g. 112 and 113) may be implemented using PMOS 116 and NMOS 114 transistors with different gate dimensions in different output stages 112. Since the transistors of the different output stages are driven with the same voltage signal provided from the charge pump, they will pass different amounts of current. As a result, the regulated output voltages produced by the different output stages (e.g. 112 and 113) will be different.

In one or more embodiments, a regulator circuit is provided that does not include a difference amplifier to provide feedback to the oscillator. FIG. 5 shows a circuit diagram of a regulator circuit that uses a charge pump 504 driven by a fixed frequency oscillator 502, in accordance with an example embodiment.

The regulator circuit includes a plurality of output stages 512 and 513 that are driven by a voltage signal vhv produced by the charge pump 504. Each output stage has an input driven by a voltage signal output from the charge pump 504. Each output stage (e.g. 513) drives one or more regulated output voltages (vout1–voutn) using a transistor 518 arranged in a source follower configuration with respective current source 522. Current source 522 biases the transistor 518 according to a reference current iref2.

The charge pump 504 charges one or more energy storage elements to produce a voltage signal at a rate controlled by the fixed frequency oscillator. A control circuit 506 is configured to limit voltage provided to a power supply pin of the charge pump 504 in response to the regulated output voltage of one or more of the plurality of output regulators. The control circuit 506 is a replica of the transistor 118 of the one of the output stages. This ensures sufficient voltage vhv is output from the charge pump 504 without exceeding technology limits.

Transistor 516 of each output stage (e.g. 513) operates with transistor 510 to mirror reference current iref provided by reference current/voltage generator 508. The mirrored current iref biases a replica transistor 520, which provides a gate voltage to NMOS transistor 518. By controlling the source of the replica transistor devices via a voltage reference/voltage clamp circuit, the output voltage is changed accordingly. Thus, independently programmable output voltages can be generated.

A startup circuit provides the initial supply voltage to the charge pump. The startup circuit may be implemented, for example, by a comparator that turns on a weak switch driving a clamp circuit. The comparator monitors an internal voltage and compares it to one of the reference voltages, to decide when the internal replica bias is sufficient. Until then, it enables a weak switch to supply. In order to prevent voltage overshoot, a weak switch is used that drives a clamp circuit. The clamp only draws current if the supply exceeds a maximum level. After the comparator turns off the switch, it will not consume any current.

Each output stage may be selectably enabled or disabled by PMOS transistor 514 in response to a respective enable signal (En_1, En_n) provided to the output regulator by an enable control circuit, and may be used to power one or more loads. Output stages may provide power for different sections of a power grid or for separate circuits as described with reference to FIG. 1. The replica transistor 520 of each output stage may also be biased with a respective reference voltage generated by the current/voltage generator 508 to adjust the regulated output voltage of the output stage 512. In this manner, different output stages may be programmably adjusted to produce different regulated output voltages.

The embodiments are thought to be applicable to a variety of applications which require one or more regulated voltages such as a personal electronic device, a hand-held device, a computer device, etc. Based upon the above discussion and illustrations, those skilled in the art will readily recognize that various modifications and changes may be made without strictly following the exemplary embodiments and applications illustrated and described herein. Furthermore, various features of the different embodiments may be implemented in various combinations. Such modifications do not depart from the true spirit and scope of the present disclosure, including that set forth in the following claims.

What is claimed is:

1. A circuit for providing a regulated output voltage, the circuit comprising:

a variable frequency oscillator;

a control circuit configured and arranged to adjust an oscillation frequency of the variable frequency oscillator in response to a feedback signal indicating the regulated output voltage;

a charge pump having a control input coupled to an output of the variable frequency oscillator and configured to charge one or more energy storage elements in response to the output of the variable frequency oscillator to produce a voltage signal;

a plurality of output stages, each output stage having an input driven by the voltage signal and configured and arranged to drive the regulated output voltage at the output node in response to respective enable signals provided to the output stages; and an enable control circuit configured and arranged to provide the respective enable signals.

2. The circuit of claim 1, wherein the control circuit includes:

a replica output stage, configured to produce a feedback voltage proportional to the regulated output voltage, the replica output stage having an input driven by the voltage signal; and a difference amplifier having a first input coupled to an output of the replica output stage, a second input coupled to a reference voltage, and an output coupled to a control input of the variable frequency oscillator.

3. The circuit of claim 2, wherein each output stage includes an NMOS transistor arranged in a source follower configuration.

4. The circuit of claim 3, wherein each output stage includes:

the NMOS transistor and an enable switch coupled in series between a Vcc voltage and the NMOS transistor, the NMOS transistor having a gate driven by the voltage signal, and the switch controlled by the corresponding enable signal; and a current source coupled between the output of the output stage and ground.

5. The circuit of claim 3, wherein the current source is a variable current source having a control input coupled to a bias reference current.

6. The circuit of claim 2, wherein:

the difference amplifier is a transconductance amplifier; and the variable frequency oscillator is a current controlled oscillator.

7. The circuit of claim 2, wherein:

the difference amplifier is a voltage amplifier; and the variable frequency oscillator is a voltage controlled oscillator.

8. The circuit of claim 2, wherein the voltage amplifier is a differential voltage amplifier.

9. The circuit of claim 2, wherein the difference amplifier is biased by the bias reference current.

10. The circuit of claim 2, wherein the replica output stage is configured and arranged to leak a current sufficient to maintain the voltage signal below a maximum value.

11. The circuit of claim 1, wherein the charge pump, the variable frequency circuit, and the replica output stage form a self-biasing circuit configured and arranged to maintain the voltage signal at a stable value.

12. The circuit of claim 1, wherein the output stages are coupled to one another in parallel.

13. A circuit comprising:

an oscillator;

a charge pump having a control input coupled to an output of the oscillator, the charge pump being configured and arranged to charge and discharge a plurality of energy storage elements in response to the output of the oscillator, to produce a voltage signal at a rate controlled by the oscillator;

a plurality of output stages, each output stage having an input driven by the voltage signal and configured to provide a respective regulated output voltage in response to respective enable signals provided to the output stages; and a control circuit configured to limit current provided to a power supply pin of the charge pump in response to the regulated output voltage of one or more of the plurality of output regulators.

14. The circuit of claim 13, wherein the oscillator is a fixed frequency oscillator and the respective regulated output voltage of a first one of the plurality of output stages is different than the respective regulated output voltage of at least a second one of the plurality of output stages.

15. The circuit of claim 13, wherein each output stage includes: an NMOS transistor arranged in a source follower configuration.

16. The circuit of claim 15, wherein each output stage includes:

the NMOS transistor and an enable switch coupled in series between a Vcc voltage and an output of the output stage, the NMOS transistor having a gate coupled to the output of the charge pump, and the switch controlled by the corresponding enable signal; and a variable current source coupled between the output of the output stage and ground, the variable current source having a control input coupled to a bias reference current.

17. The circuit of claim 13, wherein for each of the plurality of output stages, the low-drop-out regulator circuit includes a respective current mirror configured and arranged to bias the voltage signal produced by the charge pump by a respective reference voltage, and drive an input of the corresponding output stage using the biased voltage pulses.

18. A regulator circuit comprising:

an oscillator;

a charge pump having a control input coupled to an output of the oscillator, the charge pump being configured and arranged to charge one or more energy storage elements, in response to the output of the oscillator, to produce voltage signal at a rate controlled by the oscillator; and a plurality of output stages, each output stage having an input driven by the voltage signal and configured to provide one or more respective regulated output voltages in response to respective enable signals provided to the output stages;

a control circuit configured and arranged to adjust the voltage signal, via the charge pump, in response to one or more of the one or more respective regulated output voltages.

19. The regulator circuit of claim 18, wherein:

the oscillator is a variable frequency oscillator; and the control circuit is configured and arranged to adjust the voltage signal via the charge pump by adjusting an oscillation frequency of the variable frequency oscillator in response to a feedback signal indicating one or more of the one or more respective regulated output voltages.

20. The regulator circuit of claim 19, wherein:

the oscillator is a fixed frequency oscillator; and the control circuit is configured and arranged to adjust the voltage signal via the charge pump by limiting current provided to a power supply pin of the charge pump in response to the regulated output voltage of one or more of the plurality of output regulators.

* * * * *